US010971869B2

(12) United States Patent
Clemens et al.

(10) Patent No.: US 10,971,869 B2
(45) Date of Patent: Apr. 6, 2021

(54) DEVICE FOR LOCKING A PLUG ON A SWITCHABLE POWER SOCKET

(71) Applicant: BSH HAUSGERAETE GMBH, Munich (DE)

(72) Inventors: Kay-Uwe Clemens, Haag in Oberbayern (DE); Rafael Kirschner, Munich (DE); Philip Laukart, Munich (DE)

(73) Assignee: BSH Hausgeraete GmbH, Munich (DE)

( * ) Notice: Subject to any disclaimer, the term of this patent is extended or adjusted under 35 U.S.C. 154(b) by 263 days.

(21) Appl. No.: 16/086,022

(22) PCT Filed: Feb. 20, 2017

(86) PCT No.: PCT/EP2017/053791
§ 371 (c)(1),
(2) Date: Sep. 18, 2018

(87) PCT Pub. No.: WO2017/157616
PCT Pub. Date: Sep. 21, 2017

(65) Prior Publication Data

US 2020/0295515 A1 Sep. 17, 2020

(30) Foreign Application Priority Data

Mar. 18, 2016 (DE) ..... 10 2016 204 505.9

(51) Int. Cl.
*H01R 13/703* (2006.01)
*H01R 13/639* (2006.01)
*H01R 24/28* (2011.01)

(52) U.S. Cl.
CPC ..... *H01R 13/7038* (2013.01); *H01R 13/6395* (2013.01); *H01R 24/28* (2013.01)

(58) Field of Classification Search
CPC ..... H01R 13/6395; H01R 13/6392; H01R 13/639; H01R 31/06; H01R 13/7038; H01R 24/28
(Continued)

(56) References Cited

U.S. PATENT DOCUMENTS 7,184,258 B2 2/2007 Lai
2010/0029110 A1* 2/2010 Kiryu ..... H01R 13/707 439/188

FOREIGN PATENT DOCUMENTS

CN 2726165 Y 9/2005
CN 204088786 U 1/2015
(Continued)

*Primary Examiner* — Gary F Paumen
(74) *Attorney, Agent, or Firm* — Laurence A. Greenberg; Werner H. Sterner; Ralph E. Locher

(57) ABSTRACT

A device for protecting a plug-in connection between a first power plug of an electric appliance and a switchable power socket. The switchable power socket has a socket for receiving the first power plug and a second power plug for coupling the switchable power socket to an electrical mains. The device has a wall which, when the device is installed, at least partially surrounds the switchable power socket with the first power plug plugged therein. The wall is formed with a plug-side recess in which the second power plug at least partially penetrates the wall. The wall covers the first power plug at least partially, when the device is installed, in order to prevent the first power plug from being pulled out of the socket. A sensor detects whether or not the wall surrounds the switchable power socket and informs a control unit that controls the electrical device.

19 Claims, 3 Drawing Sheets

(58) Field of Classification Search
USPC ..... 439/638, 373, 369
See application file for complete search history.

(56) References Cited

FOREIGN PATENT DOCUMENTS

| | | | |
|---|---|---|---|
| CN | 204497484 | U | 7/2015 |
| DE | 3327087 | C1 | 8/1984 |
| EP | 2149940 | A1 | 2/2010 |
| FR | 2650708 | A1 | 2/1991 |

* cited by examiner

DEVICE FOR LOCKING A PLUG ON A SWITCHABLE POWER SOCKET

BACKGROUND OF THE INVENTION

Field of the Invention

The invention relates to a device for locking a power plug of an electrical appliance on a switchable power socket.

Electrical devices that are supplied by means of a power plug with electrical energy from a supply network can be provided for communal use in publicly accessible areas. In this document, a system for the provision of laundry care machines in multiple occupancy houses and/or in dedicated self-service laundries is described. For the management of communal use, an electrical device can be coupled to the supply network indirectly via a switchable power socket, wherein the switchable power socket can be radio controlled in order to activate the electrical device for use when needed.

In order reliably to prevent an unauthorized use of an electrical device, a firm locking can be provided between the power plug of the electrical device and the switchable power socket. For example, for this purpose, a barbed plug connection can be provided. However, such a barbed plug connection is disadvantageous since the connection between the plug and the switchable power socket typically can no longer be released again (e.g. for servicing purposes).

The present document concerns itself with the technical object of providing a compact and economical device for locking a power plug to a switchable power socket, having a reliable protection against withdrawal of the power plug and which nevertheless enables non-destructive releasing of the plug connection between the plug and the switchable power socket, if required.

SUMMARY OF THE INVENTION

This object is achieved with the subject matter of the independent claim. Advantageous embodiments are defined, in particular, in the dependent claims, described in the description below or represented in the accompanying drawings.

According to one aspect of the invention, a device for protecting a plug connection between a first power plug of an electrical device (e.g. a domestic appliance, for example a laundry care machine) and a switchable power socket is described. The switchable power socket comprises a receptacle for receiving the first power plug and a second power plug for coupling the switchable power socket to an electrical supply network. The first power plug and/or the second power plug can be, for example, plugs of type C, type E, type F and/or of type E+F. The switchable power socket can be, for example, a cuboid housing wherein the receptacle can be located on a rear side of the housing and the second power plug can be located on a front side of the housing, arranged opposite thereto. The switchable power socket is typically configured to make and/or break an electrically conductive connection between the second power plug and the receptacle. For this purpose, the switchable power socket can be configured to receive a control signal via a (in particular wireless) communication connection, by means of which control signal, the making and/or the breaking of the electrically conductive connection can be initiated. The electronics required for this can be situated in the housing of the switchable power socket.

The device comprises a wall or a side which is configured in an installed state at least partially to enclose the switchable power socket (in particular the housing of the switchable power socket) with the inserted first power plug. Herein, the wall has a plug-side recess at which, in the installed state, the second power plug at least partially penetrates the wall. By means of the plug-side recess, it is caused that the wall can lie against the rear side of the housing of the switchable power socket (without a substantial gap). In other words, the wall can be configured so that, in the installed state, the wall at least partially touches the rear side of the switchable power socket. Thus, the movement freedom of the device along a first axis which extends between the rear side and the front side of the switchable power socket can be reduced.

Furthermore, the wall is configured such that, in the installed state, the wall at least partially covers the first power plug in order to prevent a withdrawal of the first power plug from the receptacle. In particular, the wall can be configured for this purpose such that, in the installed state, the wall has a spacing from the front side of the switchable power socket that is smaller than the length of the first power plug in the direction of a contact pin of the first power plug.

Thus on the front side of the housing of the switchable power socket, the wall of the device can at least partially cover the receptacle of the switchable power socket and the first power plug inserted therein. Due to the fact that the wall on the rear side of the housing of the switchable power socket has no substantial movement freedom, a reliable protection of the plug connection between the receptacle of the switchable power socket and the first power plug can be provided. In particular, a withdrawal of the first power plug can thus be prevented in a reliable manner.

The switchable power socket can comprise a (particularly cuboid) housing with a rear side (on which the second power plug is arranged) with a front side (on which the receptacle is arranged) and (typically four) connecting sides between the front side and the rear side. In a Cartesian coordinate system, a first axis can extend between the rear side and the front side. A second and a third axis can extend perpendicularly to the first axis between mutually parallel arranged pairs of connecting sides. The wall of the device can enclose the front side, the rear side and at least two connecting sides of the housing of the switchable power socket. In the installed state, the wall of the device can lie against the rear side and against the at least two connecting sides of the housing of the switchable power socket (in particular without substantial movement freedom). Thus a reliable protection of the plug connection between the receptacle of the switchable power socket and the first power plug can be provided.

The plug-side recess can be configured such that, in the installed state, the wall fully encloses the second power plug. It can thus be brought about in an efficient manner that the device cannot be withdrawn along the second or third axis of the housing of the switchable power socket.

Alternatively, the plug-side recess can be arranged on one edge of the wall and can have a U-shape. A U-shaped recess can be advantageous in order to be able to push a device with a surrounding wall which forms a hollow space for receiving the housing of the switchable power socket onto the switchable power socket.

The wall can have one or more bores by means of which a connection between the device and the switchable power socket can be established, in particular by means of one or more screws or bolts which are fixed by means of the one or more bores in the housing of the switchable power socket.

By means of a connection of this type between the device and the switchable power socket, a withdrawal of the device from the switchable power socket along the second or third axis can be prevented (in particular on use of a U-shaped plug-side recess).

The wall can have a receptacle-side recess which, in the installed state, is arranged at least partially over a part of the first power plug and the receptacle. By means of a receptacle-side recess, it can be brought about that the device can be used in conjunction with different forms of the first power plug. For example, in a first form of the first power plug, the power cable can be fed out of the first power plug along an axis of the contact pins of the first power plug. Alternatively, in a second form of the first power plug, the power cable can be fed out of the first power plug along an axis perpendicular to the contact pins. By means of the provision of a receptacle-side recess, a reliable protection of the plug connection between the receptacle of the switchable power socket and the first power plug can be provided for such different forms of the first power plug.

The receptacle-side recess can extend as far as one edge of the wall. Such a recess can be advantageous in order to be able to push a device with a surrounding wall, which forms a hollow space for receiving a part of the housing of the switchable power socket, onto the switchable power socket.

The device can comprise a first part with a front wall and a second part with a rear wall. In the installed state, the rear wall is arranged on the rear side and the front wall on the front side of the housing of the switchable power socket.

The first part and the second part can be connected to one another by coupling means so that the wall of the device comes into being which forms a hollow space for receiving a part of the housing of the switchable power socket. The coupling means can herein enable a self-locking and/or interlocking connection, in particular a tongue-and-groove connection or a latching connection. In particular, the coupling means can enable a type of "cable tie latching" between the first part and the second part. The provision of a plurality of parts enables a simple mounting of the device on the switchable power socket.

Alternatively, the wall can be a single-part component which forms a hollow space for receiving at least a part of the housing of the switchable power socket. In this case, the device can be pushed onto the housing of the switchable power socket.

The wall of the device can have a thickness, for example, of 2 mm or less. The wall can be made from a plastic (for example, by means of an injection molding process).

According to another aspect of the invention, a unit is made of a plurality of partial components. The unit comprises a first power plug of an electrical device. Furthermore, the unit comprises a socket which has a receptacle into which the first power plug is inserted and which comprises a second power plug for coupling the switchable power socket to an electrical supply network. The first power plug and the second power plug can have the same plug type. In addition, the unit comprises a device described in this document which is configured to prevent a withdrawal of the first power plug from the receptacle.

The first power plug can be connected, for example, electrically conductively to a laundry care machine (in particular to a washing machine or to a laundry dryer). The switchable power socket can be configured to break and/or to make an electrically conductive connection between the laundry care machine and an electrical supply source. Furthermore, the switchable power socket can be configured to receive a signal via a communication connection by means of which the electrically conductive connection is caused to be made or broken. By means of the device described in this document, therefore, an inadmissible use of the laundry care machine can be prevented in a reliable and efficient manner.

The switchable power socket can comprise a sensor which is configured to detect whether the wall of the device at least partially surrounds the switchable power socket or not. The sensor can comprise, for example, a touch sensor. The sensor signal can be transferred via the communication connection to a control unit of a system for the communal use of an electrical device. It can thus be determined in a reliable manner whether a protection of the plug connection exists between the first power plug and the switchable power socket or not. In particular, an inadmissible removal of the protective device can be detected and countermeasures can possibly be instigated.

According to another aspect of the invention, a system for communal use of a cable-bound electrical appliance (in particular a laundry care machine) is described. The laundry care machine can comprise, in particular, a washing machine, a laundry dryer and/or a washer-dryer. The system comprises a control unit which is configured to determine that a user wishes to use the electrical appliance (in particular the laundry care machine) in a first time period. Herein, the control unit can comprise a processor, in particular a server.

The control unit is typically spatially separated from the laundry care machine. For example, the laundry care machine can be arranged in a multiple occupancy house or in a self-service laundry. Alternatively, the control unit can be arranged outside the multiple occupancy house or the self-service laundry, for example in a server room. Typically, a control unit for the control of a plurality of different laundry care machines is provided wherein the different laundry care machines can be placed at different locations.

The system further comprises at least one of the units described in this document with a switchable power socket and a device for protecting a plug connection. The switchable power socket can be configured to break and/or to make an electrically conductive connection between the electrical appliance (in particular the laundry care machine) and an electrical supply source (e.g. an electrical supply network). The control unit can be configured to cause, via a WAN communication connection (i.e. via a Wide Area Network connection), the switchable power socket to make the electrically conductive connection for the first time period.

The system thus enables a user to activate and/or to reserve a laundry care machine for use remotely via a central control unit. By means of the device described in this document, a reliable protection of the plug connection between the power plug of the electrical appliance (in particular the laundry care machine) and a switchable power socket is ensured. Thus a convenient and reliable communal use of a laundry care machine can be provided.

It should be noted that each aspect of the device, units and systems described in this document can be combined with one another in a wide variety of ways. In particular, the features of the claims can be combined in a wide variety of ways.

BRIEF DESCRIPTION OF THE SEVERAL VIEWS OF THE DRAWING

The invention will now be described in greater detail making reference to the exemplary embodiments illustrated in the drawings. In the drawings.

DESCRIPTION OF THE INVENTION

As set out in the introduction, the present document concerns itself with the authorized locking of a plug connection between a power plug and a switchable power socket, so that if required, a non-destructive release of the plug connection is enabled. In this regard, by way of example making reference to FIG. 1, a system 100 for the use of a laundry care machine by a plurality of different users is described in which a device for locking a plug connection can be deployed.

Figure 1:
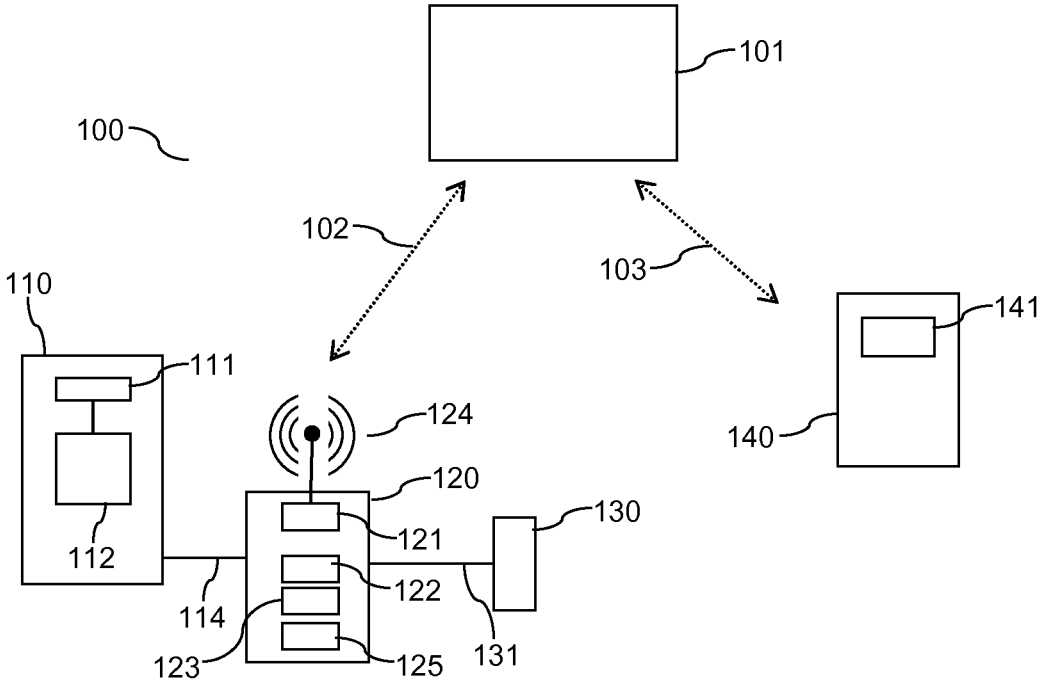
FIG. 1 shows a block diagram of an exemplary system for controlling a communally used laundry care machine.

The system 100 shown in FIG. 1 comprises a central control unit 101 which is configured to communicate via a first cable-free communication connection (in particular via a wireless WAN (Wide Area Network) communication connection) 102 with a communication module 120 for a communally used laundry care machine 110. Furthermore, the control unit 101 is configured to communicate via a second communication connection (in particular via a cable-free WAN communication connection) 103 with an electronic device 140 (e.g. with a smartphone or a tablet PC) of a user.

The electronic device 140 has an input/output module 141 (e.g. with a touch-sensitive screen) by means of which the user can undertake inputs and view outputs. In particular, a software application (an "app") can run on the electronic device 140, enabling a user to make a request to the control unit 101 for use of the laundry care machine 110. A user can be enabled thereby to reserve, via the electronic device 140, a time period for the use of the laundry care machine 110. For example, the control unit 101 can maintain a digital calendar for the use of the laundry care machine 110 and the user can be enabled to reserve a particular time period in the digital calendar.

The control unit 101 is further configured to control the communication module 120 of the laundry care machine 110 dependent upon an input by the user. The communication module 120 can be configured to connect an electrical supply line 114 of the laundry care machine 110 to an electrical supply network 130 (or with a connecting line 131 to the supply network 130) or to separate the electrical supply line 114 of the laundry care machine 110 from the electrical supply network 130. For this purpose, the communication module 120 can comprise a controllable switch 122 (e.g. a relay) which is configured to make or break the electrically conductive connection between the supply line 114 of the laundry care machine 110 and the electrical supply network 130.

The communication module 120 further comprises a control element 121 (which comprises, for example, a processor) which is configured to receive a control signal via the first communication connection 102 from the control unit 101 and to close and/or open the switch 122 dependent upon the control signal. For example, the control unit 101 can cause the communication module 120 to close the switch 122 in a time period in which the laundry care machine 110 has been reserved by a user. The laundry care machine 110 is then connected to the electrical supply network 130 during this time period and can thus be used by the user. Alternatively, the control unit 101 can cause the communication module 120 to open the switch 122 in a time period in which there is no reservation for the laundry care machine 110. The laundry care machine 110 is then not connected to the electrical supply network 130 during this time period and thus cannot be used. Therefore an inadmissible use of the laundry care machine 110 can be prevented.

Laundry care machines 110 are often placed in cellar rooms in which wireless communication is often limited (in particular a communication via a Wireless Local Area Network, WLAN). The communication module 120 can therefore be configured to communicate via a Global System for Mobile Communications (GSM) network, in particular via the GSM data services such as GPRS and/or EDGE. Through the use of GSM, a wireless communication connection can be provided in an efficient and reliable manner between a central control unit 101 (e.g. with a back end server) and a plurality of distributed communication modules 120 (for a corresponding plurality of distributed laundry care machines 110). For the establishment of the first communication connection 102, a communication module 120 can comprise a suitable antenna 124.

The communication module 120 can further comprise a current sensor 123 (in particular a supply meter) which is configured to record an indicator for the quantity of electrical energy that has been drawn from the supply network 130 by the laundry care machine 110 during a reserved time period. In particular, the current quantity consumed can be recorded as an indicator for the quantity of electrical energy. The indicator for the quantity of electrical energy can be transferred via the first communication connection 102 to the central control unit 101. Furthermore, the control unit 101 can calculate for the user the use of the laundry care machine 110 dependent upon the indicator for the quantity of electrical energy. For example, for this purpose, an electronic billing of the use (e.g. by means of stored billing data) can take place. The convenience of the use of a communally used laundry care machine 110 can thus be enhanced.

The laundry care machine 110 typically comprises an input/output module 111 by means of which a user can control the laundry care machine 110. In particular, the user can select a suitable operating program and/or activate and/or deactivate the laundry care machine 110. The laundry care machine 110 further comprises a control element 112 which is configured to operate the laundry care machine 110 dependent upon an input by the user.

The communication module 120 can be independent of the type or the manufacturer of the laundry care machine 110. In particular, the communication module 120 can possibly be connected to the laundry care machine 110 only via the electrical supply line 114. For example, the communication module 120 can be configured as a switchable power socket and can comprise a receptacle or a socket into which a (typically standardized) mains plug or power plug of the electrical supply line 114 (e.g. a plug of the type C (CEE 6/17) or a plug of the type E (CEE 7/5), a plug of the type F (CEE 7/4) or a plug of the type E+F (CEE 7/7) can be inserted. Thus a generic (and therefore cost-effective) communication module 120 for different types of laundry care machines 110 can be provided. However, by means of the recording of an indicator for the quantity of electrical energy, a precise usage-dependent and possibly operating program-dependent billing can take place.

Figure 2:
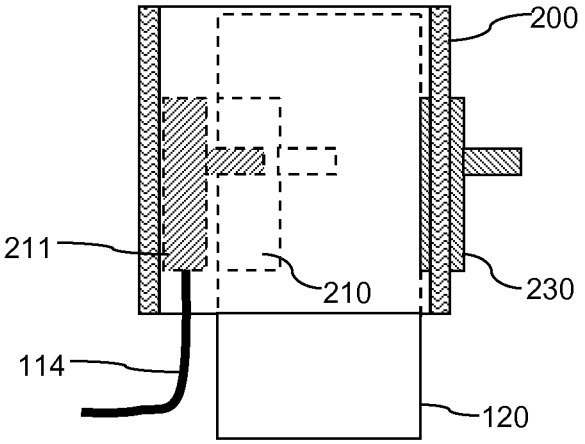
FIG. 2 shows a side view of a plug connection between a power plug and a communication module.

FIG. 2 shows an exemplary communication module 120 in side view configured as a switchable power socket. The switchable power socket 120 comprises a receptacle 210, into which a first power plug 211 of an electrical device 110 (in particular of a laundry care machine 110) can be inserted. Furthermore, the switchable power socket 120 comprises a second power plug 230 which can be inserted into the socket of a supply network 130 (e.g. to create the connecting line 131 shown in FIG. 1). The receptacle 210 and/or the second power plug 230 can each correspond to one of the aforementioned types.

FIG. 2 shows a device 200 with which a withdrawal of the first power plug 211 from the receptacle 210 can be prevented. In particular, by means of the device 200, it can be prevented that by withdrawal of the first power plug 211, the switchable power socket 120 is bypassed, for example, to enable an unauthorized use of the electronic device 110 that is connected to the first power plug 211. The device 200 can thus be used to provide in a reliable manner the system 100 described in relation to FIG. 1 for the communal use of an electrical device 110.

Figure 3:
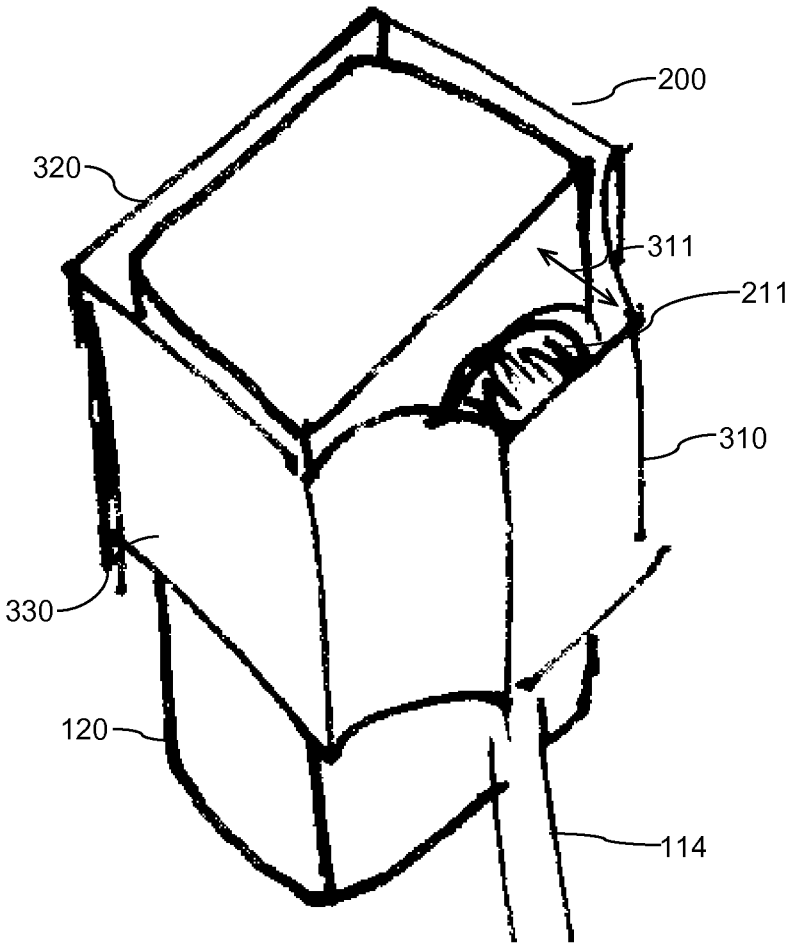
FIG. 3 shows a sketch of an exemplary device for locking the plug connection between a power plug and a communication module.

FIG. 3 shows a sketch of an exemplary protective device 200 which encloses a switchable power socket 120 and a first power plug 211 inserted thereinto. In the example shown in FIG. 3, the protective device 200 is configured as a hollow cuboid with a peripheral wall 310, 320, 330 which partially encloses the housing of the switchable power socket 120. The peripheral wall 310, 320, 303 comprises a rear wall 320, two side walls 333 and a front wall 310. The rear wall 320 is arranged at the side of the switchable power socket 120 at which the second power plug 230 of the switchable power socket 120 is located (this side is also designated the rear side of the switchable power socket 120 in this document). The front wall 310 is arranged at the side of the switchable power socket 120 at which the receptacle 210 is located (this side is also designated the front side of the switchable power socket 120 in this document).

The protective device 200 encloses the switchable power socket 120 such that a user is prevented from pulling the first power plug 211 of an electrical device 110 out of the receptacle of the switchable power socket 120. For this purpose, the front wall 310 of the protective device 200 has a spacing 311 from the front side of the switchable power socket 120 that is smaller than the length of the first power plug 211 (in the direction of the contact pins of the power plug 211).

Figure 4A:
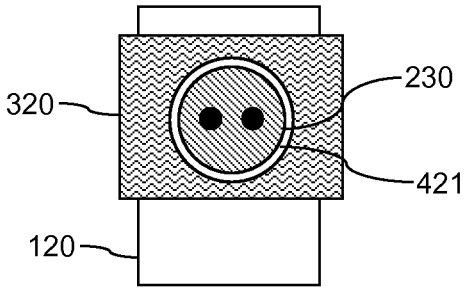
FIGS. 4*a* to 4*d* show different representations of an exemplary device for locking the plug connection between a power plug and a communication module.
Figure 4B:
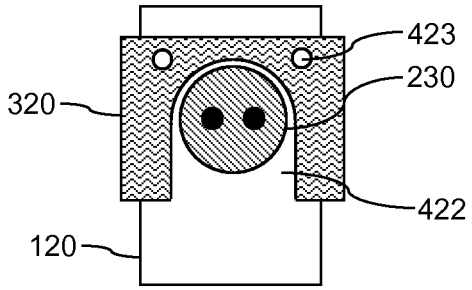
Figure 4C:
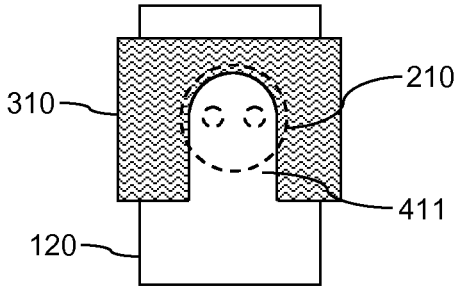

The protective device 200 comprises fastening means which prevent the protective device 200 from being able to be removed from the switchable power socket 120. Exemplary fastening means are shown in FIGS. 4*a* and 4*b*. The protective device 200 shown in FIG. 4*a* comprises on the rear wall 320 a closed recess 421 for receiving the second power plug 230 of the switchable power socket 120. By means of such a closed recess 421, it can be prevented that the protective device 200 is pulled off the switchable power socket 120 along the sides of the switchable power socket 120. By means of the use of a closed recess 421 which encloses the plug 230 of a switchable power socket 120, an economical withdrawal protection can be provided.

FIG. 4*b* shows the rear wall 320 of a protective device 200 with a (possibly open) recess 422 which is configured, for example, partially to enclose the second power plug of the switchable power socket 120. Furthermore, the rear wall 320 comprises one or more bores 423 which can be used to fasten the protective device 200, for example, by means of screws and/or bolts, to the housing of the switchable power socket 120. The bores 423 can be arranged such that the screws and/or bolts used can also serve to close the housing of the switchable power socket 120. Thus, an efficient fastening of the protective device 200 to the switchable power socket 120 can be brought about. The provision of an open recess 422 is advantageous since it enables the pushing of the protective device 200 onto the housing of the switchable power socket 120.

The front wall 310 of the protective device 200 is configured to prevent a withdrawal of a power plug 211 from the receptacle 210 of the switchable power socket 120. For this purpose, in the installed state, the front wall 310 of the protective device 200 at least partially covers the receptacle 210 of the switchable power socket 120 and the first power plug 211 inserted thereinto. Furthermore, the front wall 310 can comprise a (possibly open) recess 411 which in the installed state of the protective device 200 is situated at least partially over the receptacle 210 of the switchable power socket 120. The provision of such a recess 411 is advantageous in order to enable the use of different variants and/or forms of first power plugs 211. For example, first power plugs 211 can thus be used in which the connecting cable 114 is fed from the power plug 211 in the longitudinal direction to the contact pins. The use of an open recess 411 on the front side 310 further enables a pushing of the protective device 200 along the sides of the switchable power socket 120.

The protective device 200 can be manufactured as a single part which forms a hollow space for receiving the switchable power socket 120 and which can be pushed onto the switchable power socket 120 with a power plug 211 inserted and can be fixed on the housing of the switchable power socket 120 (e.g. by means of one or more bores 423).

Figure 4D:
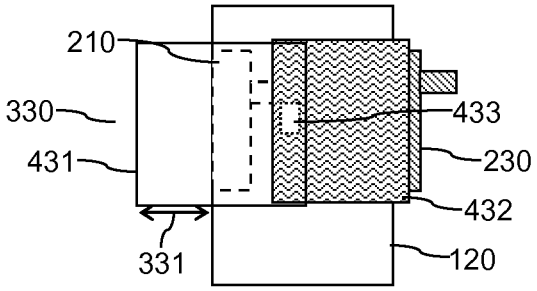

FIG. 4*d* shows a protective device 200 in a side view wherein the protective device 200 comprises a first part 431 (with the front wall 310) and a second part 432 (with the rear wall 320). The first part 431 and the second part 432 can each form a portion of the side walls 330 of the protective device 200. The respective portions of the side walls 330 can be connected to one another by means of coupling means 433, so that the protective device 200 encloses the sides of the switchable power socket 120 and so that both the parts 431, 432 of the protective device 200 can still only be parted from one another with a relatively large force application. The coupling means 433 can enable, for example, a latching of the two parts 431, 432.

The first power plug 211 of an electrical device 110 (e.g. a laundry care machine 110) can thus be connected to the receptacle 210 of a switchable plug or of a switchable power socket 120. In order to manufacture the withdrawal prevention, the protective device 200 can be guided by means of the plugged-together pairing of the first power plug 211 and the switchable power socket 120. By means of a latch-in mechanism 433 (comparable with the mechanism of a cable tie), the protective device 200 can be closed and the removal of the protective device 200 prevented. Optionally, the presence of a protective device 200 can be electrically detected by means of a sensor mounted on the switchable power socket 120. In other words, the switchable power socket 120 can comprise a sensor which is configured to detect whether the plug connection between the power plug 211 of the electrical device 110 and the receptacle 210 is protected by a protective device 200.

The protective device 200 can be configured so that the removal of the protective device 200 requires a destruction of the protective device 200. Thus, an unobserved removal and replacement of the protective device can be prevented. Alternatively, the power plug 211 and the switchable power socket 120 remain undamaged on a removal of the protective device 200, which is advantageous for servicing.

The assembly of the protective device 200 can take place in a simple manner (possibly without tools) (e.g. by pushing on or by latching in). If relevant, through the use of a sensor, the assembly and/or state of the protective device 200 can be checked remotely. For example, an opening attempt can also be detected remotely.

The protective device 200 described in this document thus represents an efficient and economical possibility for locking the plug connection between a power plug 211 and a switchable power socket 120.

The present invention is not restricted to the exemplary embodiments described. In particular, it should be noted that the description and the drawings are merely intended to illustrate the principle of the proposed device, units and systems.

The invention claimed is:

1. An assembly, comprising:

a switchable power socket having a receptacle for receiving a first power plug of an electrical device and having a second power plug for coupling said switchable power socket to an electrical supply network;

a device for protecting a plug connection between said first power plug and said switchable power socket, said device having a wall that is configured, in an installed state thereof, to at least partially enclose said switchable power socket with said first power plug inserted therein;

said wall being formed with a plug-side recess at which, in the installed state, said second power plug at least partially penetrates said wall; and said wall being configured in the installed state to cover said first power plug at least partially in order to prevent a withdrawal of said first power plug from said receptacle;

said switchable power socket having a sensor configured to detect whether or not said wall of said device at least partially surrounds said switchable power socket, and said switchable power socket transferring a signal of said sensor via a communication connection to a control unit of a system for communal use of said electrical device.

2. The assembly according to claim 1, wherein said plug-side recess is formed such that, in the installed state, said wall fully encloses said second power plug.

3. The assembly according to claim 1, wherein said plug-side recess is formed at one edge of said wall and said plug-side recess has a U-shape.

4. The assembly according to claim 1, wherein said wall is formed with one or more bores enabling a connection between said device and said switchable power socket to be established.

5. The assembly according to claim 4, wherein said one or more bores are configured for enabling the connection by way of one or more screws or bolts.

6. The assembly according to claim 1, wherein said wall is formed with a receptacle-side recess which, in the installed state, is arranged at least partially over a part of said first power plug.

7. The assembly according in claim 6, wherein the receptacle-side recess extends as far as one edge of said wall.

8. The assembly according to claim 1, wherein said wall, in the installed state, touches one side of said switchable power socket on which said second power plug is arranged.

9. The assembly according to claim 1, wherein said wall is configured to, in the installed state, form a spacing from one side of said switchable power socket on which said receptacle is arranged that is smaller than a length of said first power plug in a direction of a contact pin of said first power plug.

10. The assembly according to claim 1, wherein:

said device comprises a first part with a front wall and a second part with a rear wall; and said first part and said second part being connectable to one another by a coupling device to generate said wall with a hollow space for receiving said switchable power socket.

11. The assembly according in claim 10, wherein said coupling device enables a self-locking interlocking connection.

12. The assembly according in claim 11, wherein said self-locking interlocking connection is a tongue-and-groove connection or a latching connection.

13. The assembly according in claim 1, wherein said wall is a single-part component.

14. The assembly according to claim 1, wherein said plug-side recess is configured for a second power plug of at least one type selected from the group consisting type C, type E, type F and type E+F.

15. An assembly, comprising the first power plug recited in claim 1.

16. The assembly according in claim 15, wherein said first power plug is connected electrically conductively to a laundry care machine;

said switchable power socket is configured to selectively interrupt or establish an electrically conductive connection between the laundry care machine and an electrical supply source; and said switchable power socket is configured to receive a signal via a communication connection, causing the electrically conductive connection to be established or interrupted.

17. A system for the communal use of an electrical device, comprising:

a control unit; and an assembly according to claim 1.

18. An assembly, comprising:

a switchable power socket having a receptacle for receiving a first power plug of an electrical device and having a second power plug for coupling said switchable power socket to an electrical supply network;

a device for protecting a plug connection between said first power plug and said switchable power socket, said device having a wall that is configured, in an installed state thereof, to at least partially enclose said switchable power socket with said first power plug inserted therein;

said wall being formed with a plug-side recess at which, in the installed state, said second power plug at least partially penetrates said wall; and said wall being configured in the installed state to cover said first power plug at least partially in order to prevent a withdrawal of said first power plug from said receptacle;

said switchable power socket having a sensor configured to detect whether or not said wall of said device at least partially surrounds said switchable power socket, and said switchable power socket including a communication module configured to transfer a signal of said sensor via a communication connection to a control unit of a system for communal use of said electrical device.

19. The assembly according to claim 18, wherein said communication module communicates said signal via said communication connection wirelessly.

* * * * *